US007705783B2

(12) United States Patent
Rao et al.

(10) Patent No.: US 7,705,783 B2
(45) Date of Patent: Apr. 27, 2010

(54) SLOT-STRIP ANTENNA APPARATUS FOR A RADIO DEVICE OPERABLE OVER MULTIPLE FREQUENCY BANDS

(75) Inventors: Qinjiang Rao, Waterloo (CA); Geyi Wen, Waterloo (CA); Mark Pecen, Waterloo (CA)

(73) Assignee: Research In Motion Limited, Waterloo (CA)

( * ) Notice: Subject to any disclaimer, the term of this patent is extended or adjusted under 35 U.S.C. 154(b) by 424 days.

(21) Appl. No.: 11/697,349

(22) Filed: Apr. 6, 2007

(65) Prior Publication Data

US 2008/0246678 A1 Oct. 9, 2008

(51) Int. Cl.
*H01Q 1/38* (2006.01)
*H01Q 13/10* (2006.01)

(52) U.S. Cl. ..... 343/700 MS; 343/770

(58) Field of Classification Search ..... 343/700 MS, 343/702, 770, 895
See application file for complete search history.

(56) References Cited

U.S. PATENT DOCUMENTS

| | | | | |
|---|---|---|---|---|
| 6,292,154 | B1 * | 9/2001 | Deguchi et al. | 343/806 |
| 6,320,545 | B1 * | 11/2001 | Nagumo et al. | 343/700 MS |
| 2008/0231532 | A1 * | 9/2008 | Rao et al. | 343/770 |

FOREIGN PATENT DOCUMENTS

| | | | |
|---|---|---|---|
| EP | 1168491 | A1 | 1/2002 |
| WO | 93/12559 | A1 | 6/1993 |
| WO | 00/36700 | A1 | 6/2000 |
| WO | 00/52784 | A1 | 9/2000 |

* cited by examiner

*Primary Examiner*—Shih-Chao Chen

(57) ABSTRACT

A hybrid slot-strip antenna apparatus, and an associated methodology, for a multi-mode mobile station or other radio device. The antenna is formed of a plurality of slot-strips disposed upon a printed circuit board, or other substrate. The antenna is defined by width and length design parameters, the selections of which are determinative of the antenna functionality. Through appropriate selection of the design parameters, the antenna is operable, that is, resonant, at each of the frequency bands of the multi-mode mobile station.

15 Claims, 9 Drawing Sheets

32

SLOT-STRIP ANTENNA APPARATUS FOR A RADIO DEVICE OPERABLE OVER MULTIPLE FREQUENCY BANDS

The present invention relates generally to a radio device, such as a portable mobile station, that operates over multiple communication frequency bands. More particularly, the present invention relates to antenna apparatus and an associated method, that transduces signal energy over the multiple communication frequency bands at which the radio device operates.

The antenna apparatus is formed of a plurality of slot-strips, each individually of selected dimensions and connected together in a configuration of a selected dimension and shape such that the resultant antenna includes a portion that transduces signal energy at each of the frequency bands over which the radio device operates. An antenna is constructed for instance, for a mobile station that operates over eleven frequency bands between 800 MHz and 5.875 GHz.

BACKGROUND OF THE INVENTION

Radio communications are a pervasive part of modern society. For many, the availability of radio communication systems through which to communicate is a necessary aspect of daily life. Radio communication systems are constructed that provide both radio broadcast services as well as interactive, two-way communication services. Various radio communication systems are operable over wide areas, and others are operable over only local areas.

Cellular communication systems are amongst the radio communication systems that are widely used by many. The network infrastructures of cellular communication systems have been deployed over significant portions of the populated areas of the world. A subscriber to a cellular communication system generally subscribes for service to communicate by way of the network infrastructure of the associated communication system. Communications are generally effectuated through use of a mobile station, typically a portable, radio transceiver oftentimes of small physical dimensions permitting their hand-held operation and carriage. With continued advancements in circuit technologies, increasing functionality is able to be provided in circuitry of increasingly miniaturized dimensions. While early-generation, cellular communication systems and their associated mobile stations were used primarily for voice services, newer-generation, cellular communication systems, and their associated mobile stations, are permitting of increasingly data-intensive communication services. Different ones of the cellular communication systems operate at different frequency bands. For instance, the GSM (Global System for Mobile communications) 800 system operates at a frequency band defined between 824 and 894 MHz. The GSM 900 system operates at a frequency band extending between 890 and 960 MHz. The DCS (Digital Communication Service) system operates at a frequency band extending between 1710 and 1880 MHz. The PCS (Personal Communication Service) system operates at a frequency band extending between 1850 and 1990 MHz. The UMTS (Universal Mobile Telephone Service) operates at a frequency band extending between 1900 and 2200 MHz.

Other types of radio communication systems are also widely used. Some of such other systems share some of the aspects of cellular communication systems, or provide for interworking communications therewith. For instance, Bluetooth and WLAN (Wireless Local Area Network) communication systems provide for voice and data communication services, typically over relatively shorter ranges than the ranges over which cellular communication systems operate. Such systems are operable, e.g., in conformity with operating specifications set forth in the IEEE802.11b/g family of standards. And such systems are operable, for instance, at a frequency band located at the 2.4 GHz band. WLAN 802.11j/a systems are operable, for instance, at the 4.9-5.0 GHz, 5.15-5.35 GHz frequency band, or the 5.725-5.875 GHz frequency band. And, a GPS (Global Positioning System) radio broadcast system provides positioning services through the broadcast of signals at the 1.57 GHz band.

The various communication systems are not necessarily co-extensive. That is to say, the network infrastructures of some of such systems are deployed in some geographical areas and not others. And, in other geographical areas, other networks are deployed. Dual-mode, tri-mode, and quad-mode mobile stations are available that are permitting of their operation with two, three, and four different types of radio communication systems, respectively. Advancements in circuit technologies have permitted circuitry miniaturization that, in significant part, has permitted the multi-mode, mobile station implementations.

A challenging aspect of such multi-mode, mobile station implementations pertains to the antenna structures that transduce signal energy during the mobile-station operation. An antenna is typically of a length that is associated with the wavelengths of signal energy that is to be transduced. As noted-above, the different communication systems are operable at disparate frequency bands. As the mobile stations are increasingly packaged in small-sized housings, multi-mode devices that require antennas operable at multiple frequency bands must also be of dimensions to permit their positioning at the housing of such mobile stations.

Use of multiple antennas that operate at the different frequency bands of the multi-mode, mobile station increasingly become an impractical solution as the housing dimensions do not permit positioning of many antennas therein. PIFAs (Planar Inverted F Antennas) are sometimes used. PIFAs are compact, of low profiles, and are manufactured relatively easily. But, a PIFA is typically operable over only a narrow bandwidth. While the bandwidth of a PIFA can be increased by combining the PIFA structure with another broadband technology, such as a 3D multi-layered structure, such a combination negates, in significant part, the size advantages provided by a PIFA.

A need continues, therefore, to provide an antenna of small dimensions and capable of transducing signal energy of frequencies of multiple, disparate frequency bands.

It is in light of this background information related to antennas for radio devices that the significant improvements of the present invention have evolved.

DETAILED DESCRIPTION

Figure 1:
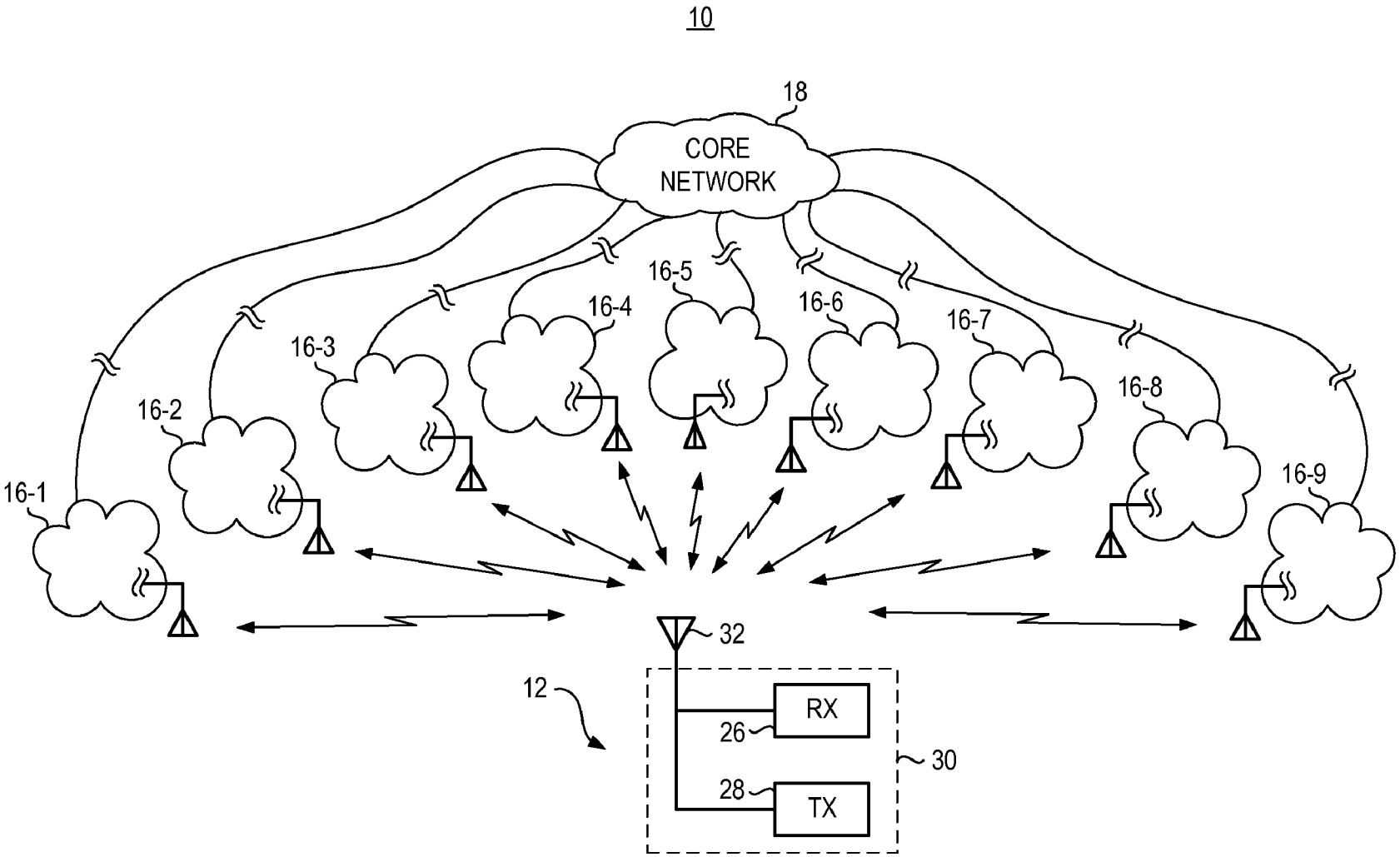
FIG. 1 illustrates a functional block diagram of a radio communication system in which an embodiment of the present invention is operable.

The present invention, accordingly, advantageously provides antenna apparatus, and an associated method, for a radio device, such as a portable mobile station, that operates over multiple frequency bands.

Through operation of an embodiment of the present invention, a manner is provided for transducing signal energy over the multiple communication frequency bands at which the radio device operates. A plurality of slot-strips are connected together in a selected shape of selected dimension such that the resultant antenna includes a portion that tranduces signal energy at each of the frequency bands over which the radio device operates. Antenna operation is provided, for instance, at frequency bands extending between 800 MHz and 5.875 GHz.

In one aspect of the present invention, the slot-strips are each individually of selected dimensions, selected in a manner such that the resultant antenna, formed of the connected-together slot-strips, includes portions that are resonant at different frequency bands at which the radio device at which the antenna is connected is operable. Thereby, irrespective of which mode, and frequency, at which the radio device is operated, the antenna is capable of transducing signal energy of the relevant frequency band.

In another aspect of the present invention, the antenna is configured into lobed portions, a serpentine-shaped portion and a partial loop portion. A slot-strip of the plurality of slot-strips forms a part of both of the lobed portions of the antenna. The serpentine-shaped portion includes, e.g., five slot-strips, including the shared slot-strip, in an end-to-end arrangement to form the serpentine configuration. The serpentine-shaped portion is of selected longitudinal and latitudinal length dimensions. And, the individual slot-strips are each of one of three selected width-wise dimensions, selected in manners best to achieve resonance at selected frequency bands of the frequency bands at which the connected radio device is operable.

In another aspect of the present invention, the lobed portion forms the partial loop is also of selected longitudinal and latitudinal lengths. The longitudinal lengths of both of the lobe portions are, e.g., of the same lengths. The individual slot-strips of the partial-loop portion are of selected widths, e.g., all of a single selected width. Again, selection is made such that the resultant antenna includes resonant portions at each of the frequency bands at which the radio device to which the antenna is connected is operable. The partial loop configuration includes three bounded sides and a fourth side that is partially unbounded. The unbounded portion of the unbounded side of the partial loop portion of the antenna is also of a selected length. The selected length is further selected such that the antenna includes resonant portions at each of the frequency bands at which the connected radio device is operable. And, the unbounded side of the partial loop portion of the antenna also includes a spur piece that also is of a selected length.

The serpentine-shaped portion and the partial-loop portion of the antenna are further separated, but for the slot-strip that is common to both portions, by another selected length. Again, the length of separation is of a magnitude to facilitate resonance of a portion of the antenna at each of the frequency bands over which the radio device is operable.

In another aspect of the present invention, the widths of the slot-strips are of one of three widths, and the lengths of the slot-strips or resultant antenna configuration are of one of seven lengths. The widths and lengths are selected such that portions of the antenna are resonant at the appropriate frequency bands. Because of the slot-strip configuration, the antenna is of small physical dimensions, permitting its positioning within the housing of a portable, mobile station, or other device of small dimensions.

In these and other aspects, therefore, an antenna apparatus, and an associated methodology is provided for a radio device operated over multiple frequency bands. A substrate is provided. And, a plurality of conductive strips are disposed upon the substrate. An end edge of each of the slot-strips of the plurality are engaged with adjacent slot-strips of the plurality. Individual ones of the slot-strips extend at angles relative to an adjacent slot-strip. Each slot-strip is of a selected width and of a selected length. Portions of the plurality exhibit resonance at levels responsive to frequency levels of signal energy therein. At least one portion of the plurality is resonant at each of the multiple frequency bands.

Turning first, therefore, to FIG. 1, a radio communication system, shown generally at 10, provides for communications with a mobile station, of which the mobile station 12 is representative. The mobile station forms a multi-mode device, capable of communication with, or by way of, multiple communication networks by way of radio air interfaces defined between the mobile station and such networks, when the mobile station is positioned within the coverage area of the associated communication network. In the exemplary implementation, the mobile station is operable at eleven different frequency bands to transceive communication signals generated during operation of any of the eleven separate communication systems. And, in the exemplary implementation, the mobile station is operable at frequency bands extending between 800 MHz and 5.875 GHz.

Here, a plurality of different networks 16 are represented. The networks 16 each represent a network-type with which the mobile station 12 is operable in the exemplary implementation. Different ones of the networks 16 operate at different frequency bands, and the signals generated during their respective operation are sent within the frequency bands within which the respective networks are operable.

The network 16-1 is representative of a GSM 800 network, operable between 824 and 894 MHz. The network 16-2 is representative of a GSM 900 network, operable at the 890-960 MHz frequency band. The network 16-3 is representative of a DCS network operable at the 1710-1880 MHz frequency band. The network 16-4 is representative of a PCS network, operable at the 1880-1990 MHz frequency band. The network 16-5 is representative of a UMTS network operable at the 1900-2200 MHz frequency band. The network 16-6 is representative of structure of a WiBro network, operable at the 2300-2390 MHz frequency band. The network 16-7 is representative of both a Bluetooth and a WLAN network operable at the 2.4 GHz frequency band. The network 16-8 is representative of a WLAN operable at any of the 4.9-5.0, 5.15-5.35, and 5.725-5.875 frequency bands. And, the structure 16-9 is representative of GPS broadcasts at the 1.57 GHz frequency band. Various of the networks 16 are connected by gateways (not shown), or other functional entities to a core network 18 and, in turn, to a communication endpoint (CE) 12.

The mobile station 12 includes transceiver circuitry, here represented by a receive (RX) part 26 and a transmit (TX) 28. The parts of the transceiver circuitry are coupled to an antenna 32 of an embodiment of the present invention. The transceiver circuitry is capable of multi-mode operation. That is to say, the transceiver circuitry is operable to operate upon signals generated in any of multiple networks, here any of the eleven separate networks. Correspondingly, the antenna 32 is also operable to transduce signal energy generated during communication operations by, and with, any of the communication networks 16. As the different networks are operable at different frequency bands, the antenna 32 is of a construction to permit signal energy of any of the frequencies of the frequency bands of which the networks are operable to be transduced. And, in the exemplary implementation, the antenna comprises a hybrid, slot-strip structure. Thereby, signal energy generated at the transceiver circuitry or received at the mobile station is able to be sent by the mobile station and operated upon by the transceiver circuitry of the mobile station to permit communication operations pursuant to any of the communication networks 16. In the exemplary implementation, the antenna 32 is disposed upon a generally planer substrate, of dimensions permitting its positioning within a housing 30 of the mobile station.

Figure 2:
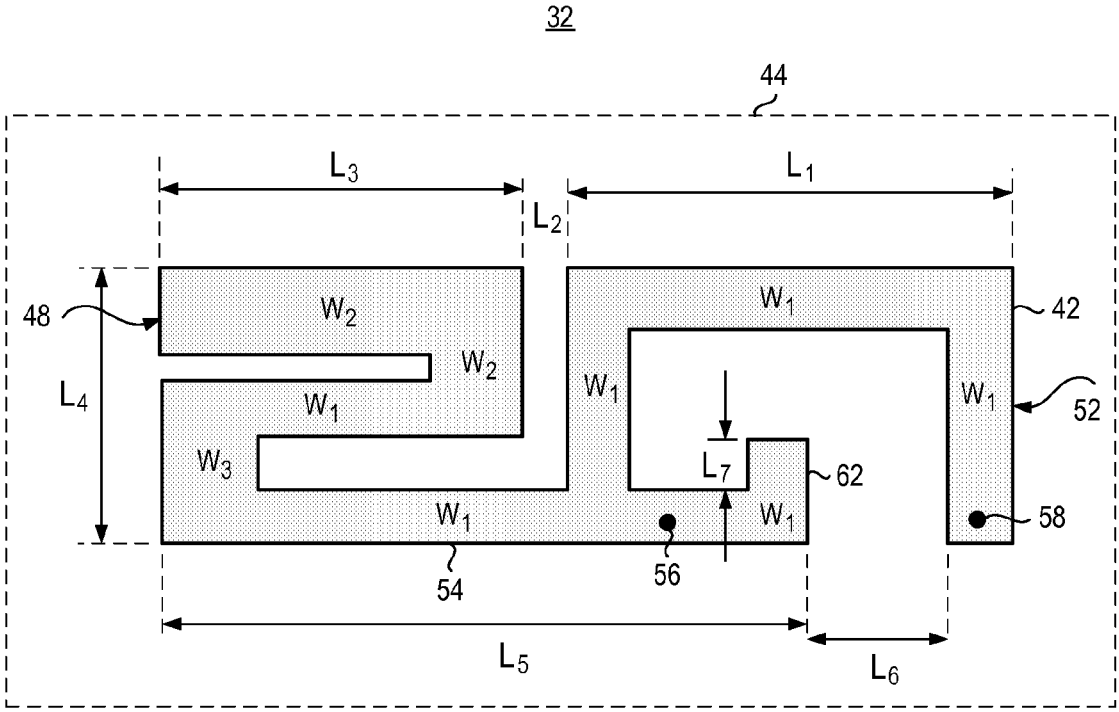
FIG. 2 illustrates a plan view of a hybrid slot-strip antenna of an embodiment of the present invention.

FIG. 2 illustrates the antenna 32 that forms part of the mobile station 12 pursuant to the exemplary implementation of an embodiment of the present invention. The antenna is formed of a plurality of slot-strips 42 disposed, etched, or otherwise formed upon a substrate 44. The slot-strips are formed such that adjacent ones of the slot-strips abut against one another and electrically engage therewith, together to form the antenna that is of a configuration that includes at least a part that is resonant at every frequency band at which the transceiver circuitry (shown in FIG. 1) is operable. Adjacent slot strips here extend at substantially perpendicular angles relative to one another. In the exemplary configuration, the antenna includes a first lobed portion 48 and a second lobed portion 52. The slot-strips of the first portion are positioned in a serpentine arrangement, resulting in, as-shown, a reverse S configuration of slot-strips. And, the second portion 52 forms a partial loop configuration with three bounded sides and a fourth side that is partially unbounded. A single slot-strip 54 is common to both the first portion and the second portion of the antenna. And, the antenna includes a feed location 56 and a ground pin location 58. The feed location 56 is connected to the biased side of the transceiver circuitry (shown in FIG. 1), and the ground pin 58 is connected to the ground side of the transceiver circuitry (shown in FIG. 1) of the mobile station.

Each of the slot-strips is of a selected width-wise dimension. Namely, each of the slot-strips is one of three widths. The widths of the individual ones of the slot-strips are indicated as $W_1$, $W_2$, and $W_3$. In the exemplary implementation, each of the slot-strips of the portion 52 are of the first width-wise dimension. And, slot-strips of the first portion are of, variously, all three of the widths. Seven lengths, identified as $L_1$ through $L_7$ are identified in the figure. The first and third lengths define latitudinal lengths of the portions 52 and 48 of the antenna. The second length defines a separation distance separating the respective portions, but for the strip 54 that is common to both portions. The fourth length defines a longitudinal length of both of the portions 48 and 52 of the antenna. A fifth length defines the length of the slot-strip 54. A sixth length defines the unbounded length of the unbounded side of the portion 52. And, the seventh length defines the length of a spur piece 62 of the unbounded side of the portion 52.

The slot-strips are located at the top of a ground plane of a printed circuit board that forms a substrate and the dimensions of the individual ones of the slot strips are determined by the design parameters of $W_j$ (j=1, 2, or 3) and $L_i$ (i=1, 2, . . . 7). The antenna is fed at the feed location 56 and shorted at the ground pin 58. The width-wise and length-wise design parameters are optimized so that the connected slot-strips operate at the multi-modes through different sections of the slot-strips. Through appropriate selection of the design parameters, at least a portion of the resultant antenna is resonant at each of the frequency bands of interest.

Figure 3:
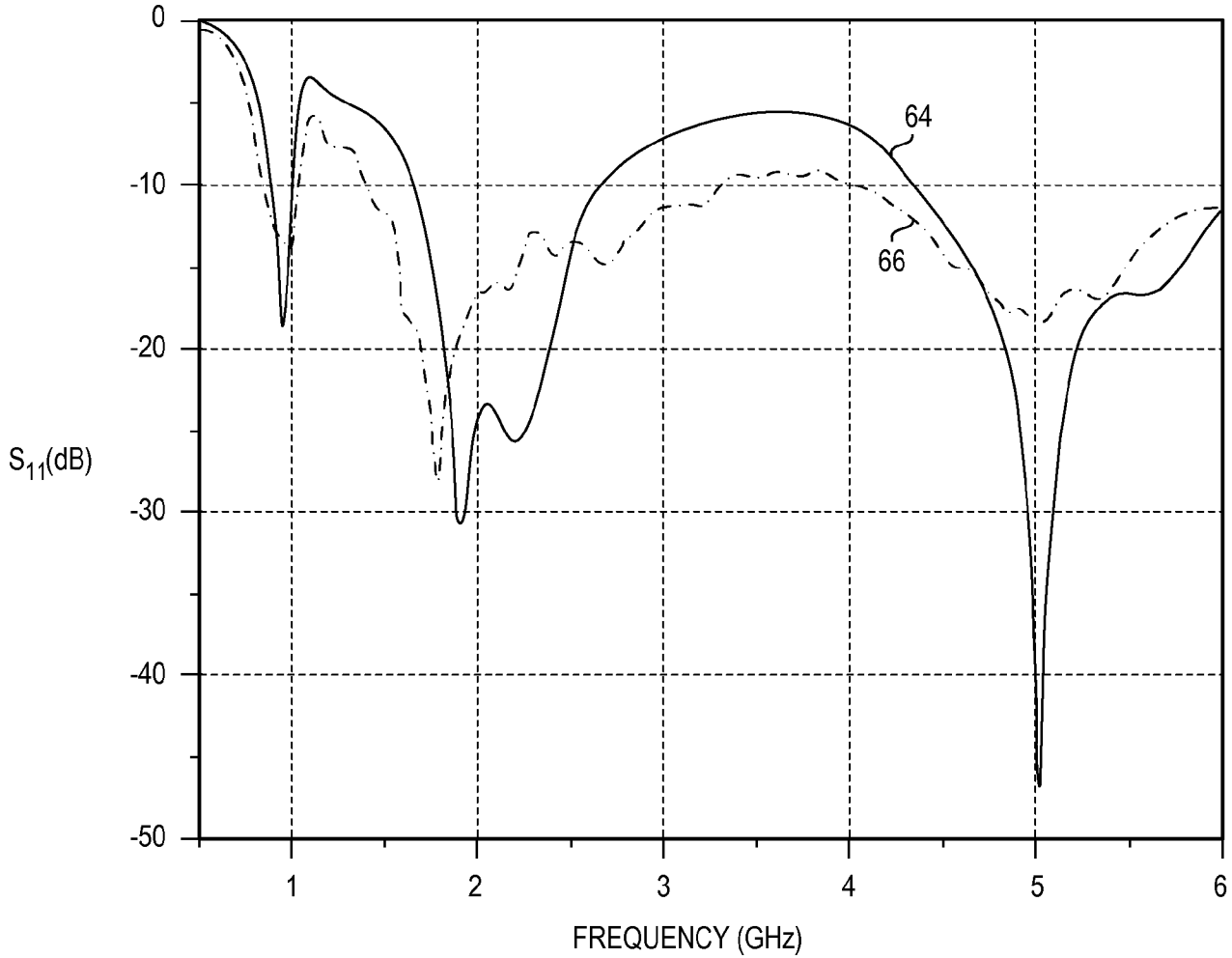
FIG. 3 illustrates a graphical representation showing simulated and measured return losses plotted across the frequencies at which the mobile station is operable.

FIG. 3 illustrates plots 64 and 66 of simulated and measured return losses, respectively, of the antenna of an embodiment of the present invention.

Figure 4:
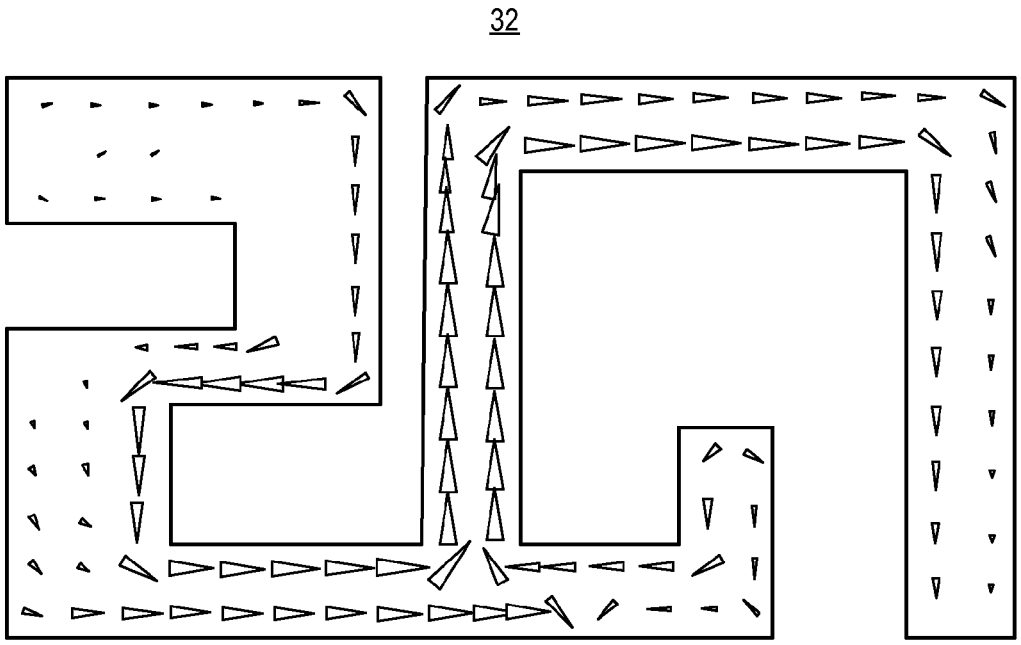
FIG. 4 illustrates a representation of the antenna shown in FIG. 2 that shows the current distribution of signal energy of a first frequency transduced at the antenna.
Figure 5:
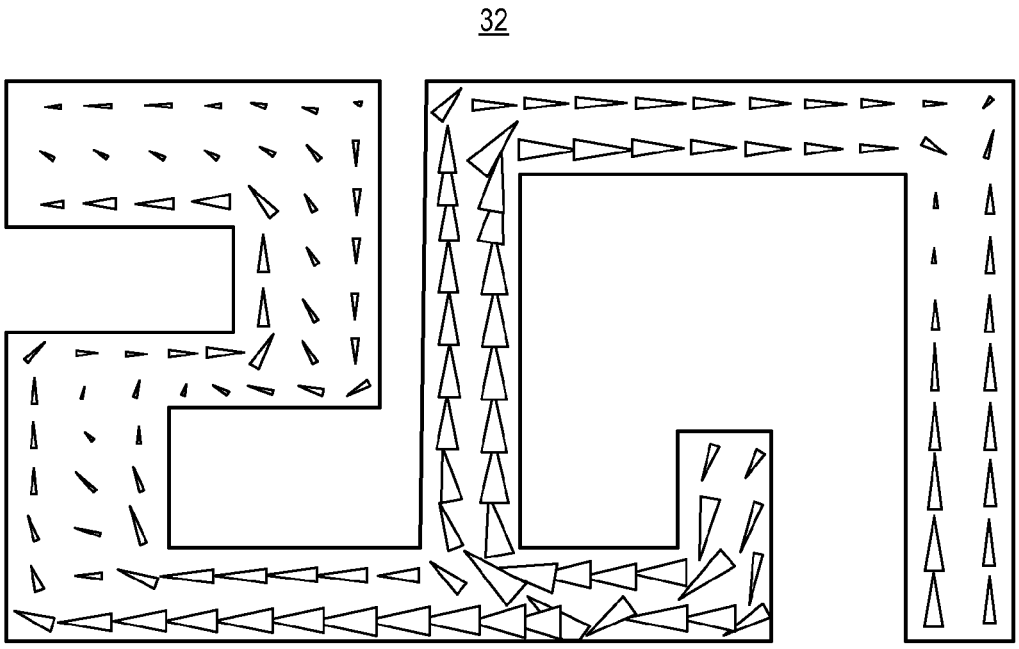
FIG. 5 illustrates a representation, similar to that shown if FIG. 3, but here showing the current distribution of signal energy of second frequency.
Figure 6:
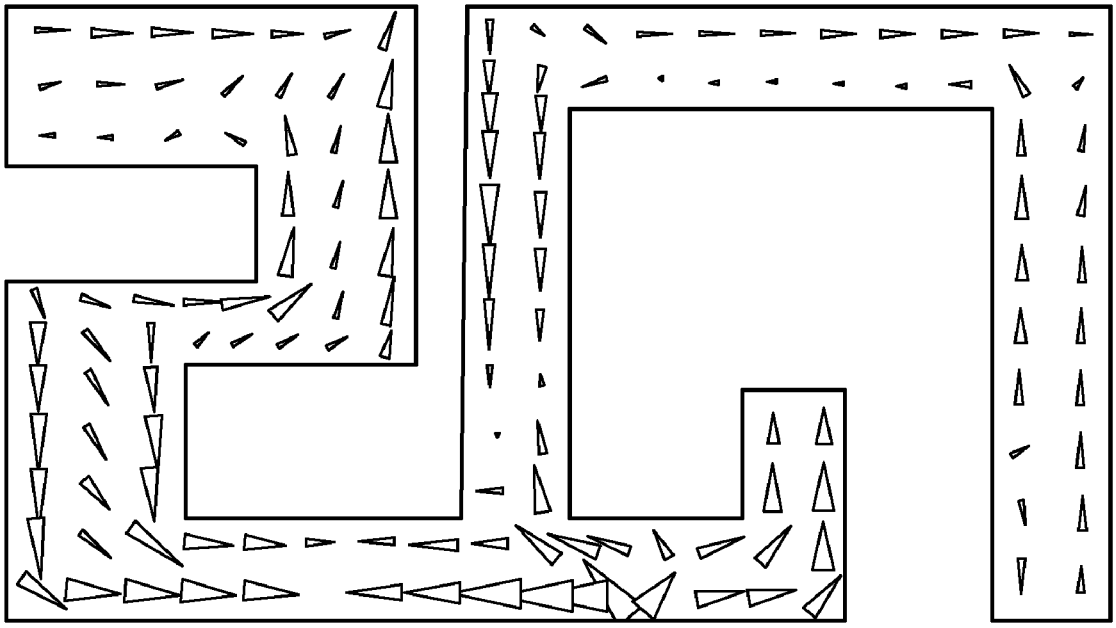
FIG. 6 illustrates a representation, similar to those shown if FIGS. 3-4, but here showing the current distribution of signal energy of a third frequency transduced by the antenna.

FIGS. 4-6 illustrate signal energy in the antenna 32 at three different frequencies. FIG. 4 illustrates a current distribution at the 900 MHz frequency band. FIG. 5 illustrates the current distribution at the 2 GHz frequency band. And, FIG. 6 illustrates the current distribution at the antenna at the 5 GHz frequency band. Comparison of the current distribution illustrates different magnitudes of current in different parts of the antenna at different frequencies.

Figure 7:
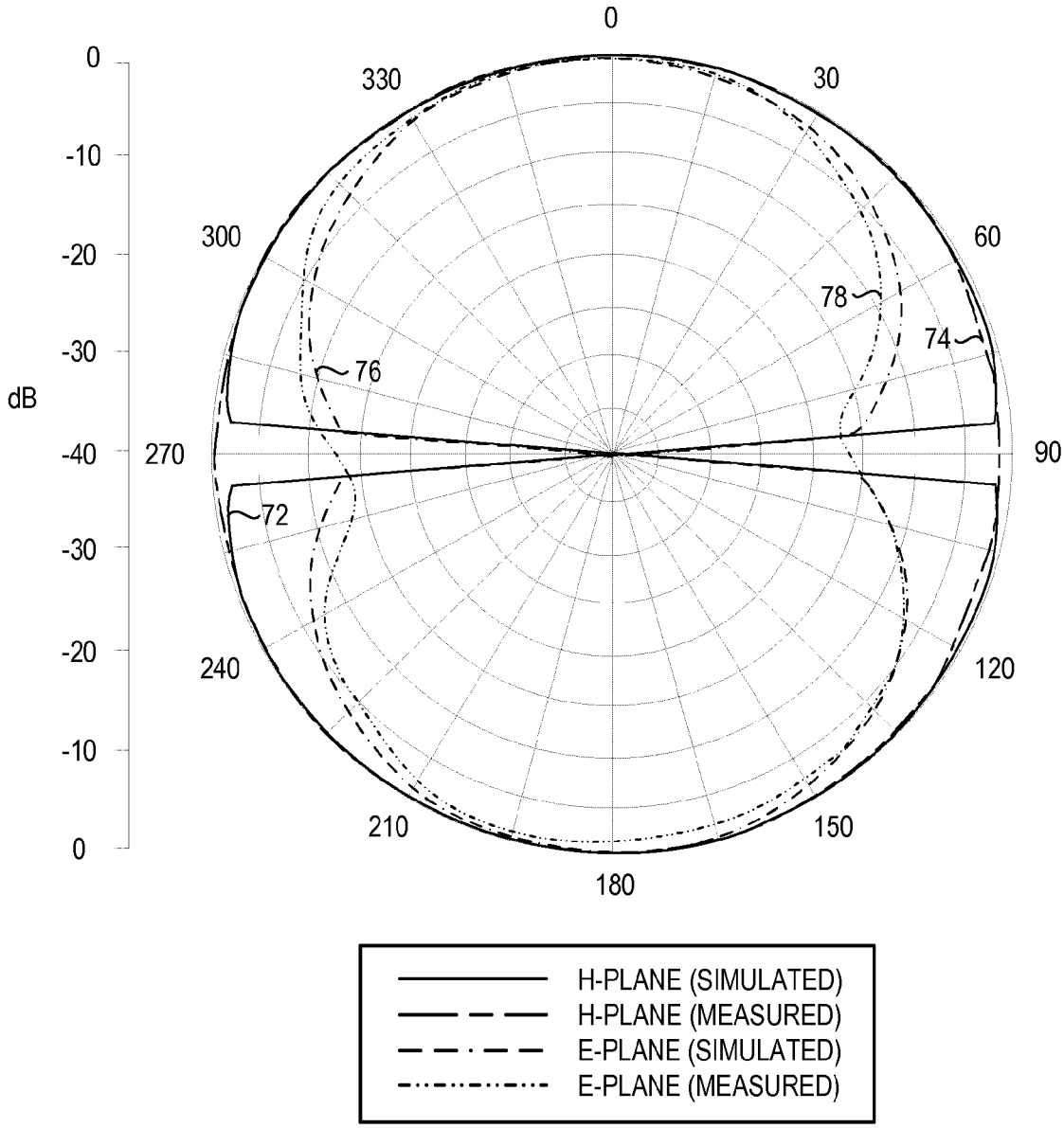
FIG. 7 illustrates an expected, normalized radiation pattern exhibited by the antenna at the first frequency.
Figure 8:
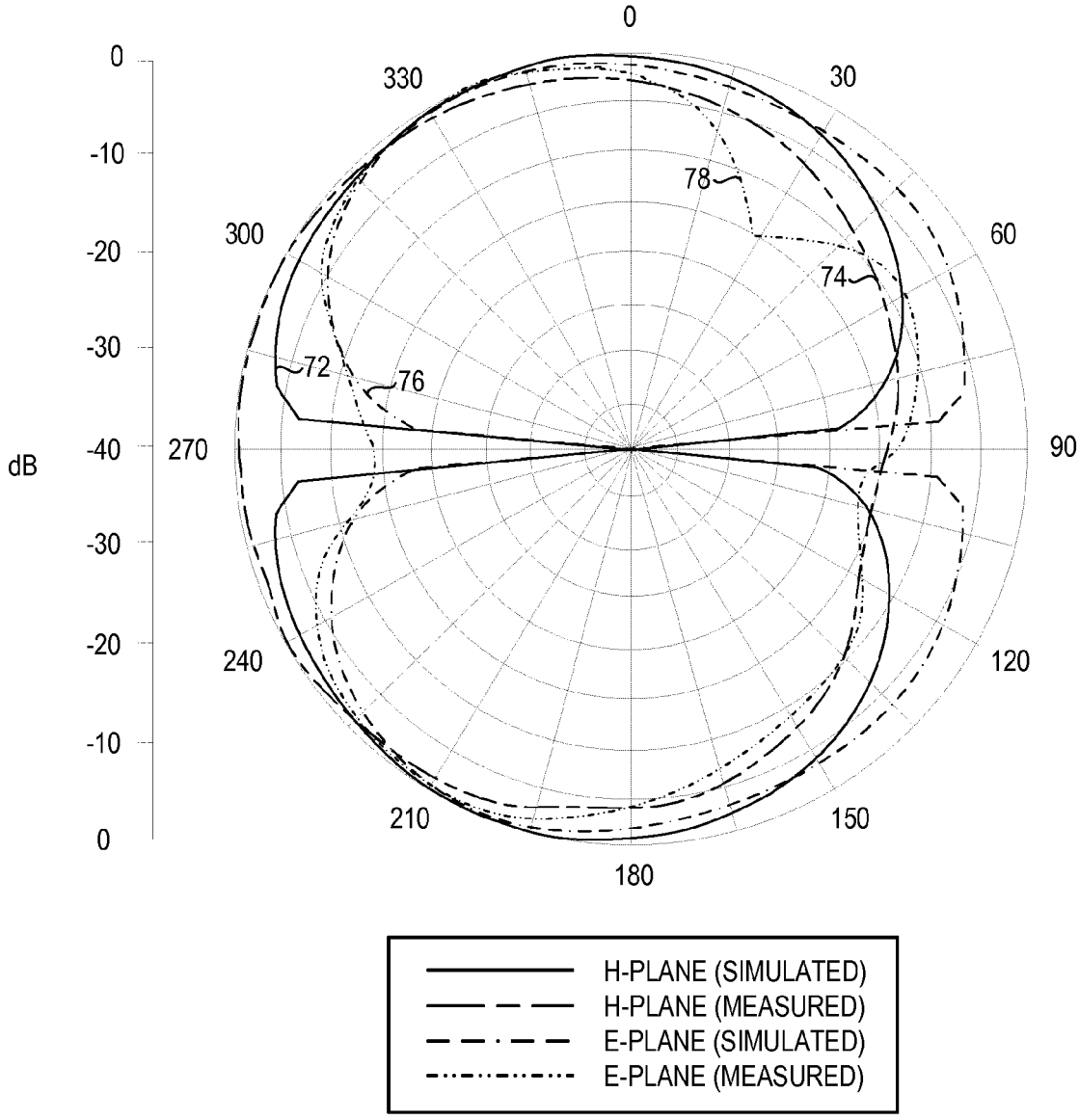
FIG. 8 illustrates a radiation pattern, similar to that shown in FIG. 6, but at the second frequency.
Figure 9:
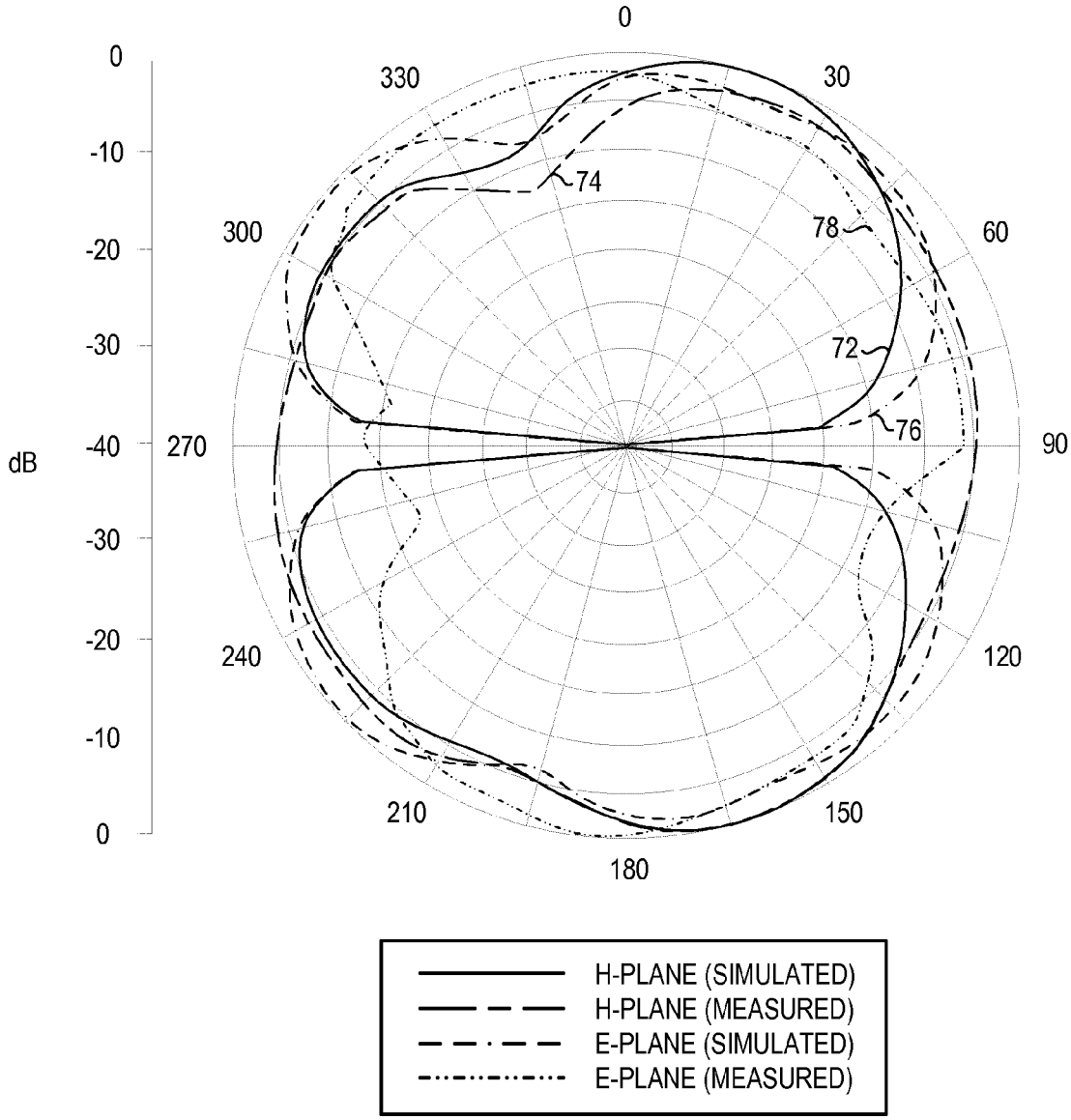
FIG. 9 illustrates a radiation pattern, similar to those shown in FIGS. 6-7, but of the third frequency.

FIG. 7-9 illustrates normalized radiation patterns at each of the three frequency bands of which the FIGS. 4-6 are representative. That is to say, FIG. 7 illustrates radiation patterns 72, 74, 76, and 78 representative of the antenna radiation pattern at the 900 MHz frequency band. FIG. 8 illustrates radiation patterns 72, 74, 76, and 78 of the antenna at the 2 GHz frequency band. And, FIG. 9 illustrates radiation patterns 72, 74, 76, and 78 exhibited by the antenna at the 5 GHz frequency band. Analysis of the radiation patterns indicate a broad radiation pattern, stable at the different frequency bands. Each of the FIGS. 7, 8, and 9 show measured and simulated patterns for both the H and the E planes. In the H plane, $\Phi=0°$ and $\Theta=0°\sim360°$. And, in the E plane, $\Phi=90°$ and $\Theta=0°\sim360°$. The lines 72 are representative of simulated, H-plane patterns. The lines 74 are representative of measured, H-plane patterns. The lines 76 are representative of simulated, E-plane patterns. And, the lines 78 are representative of measured, E-plane patterns.

Figure 10:
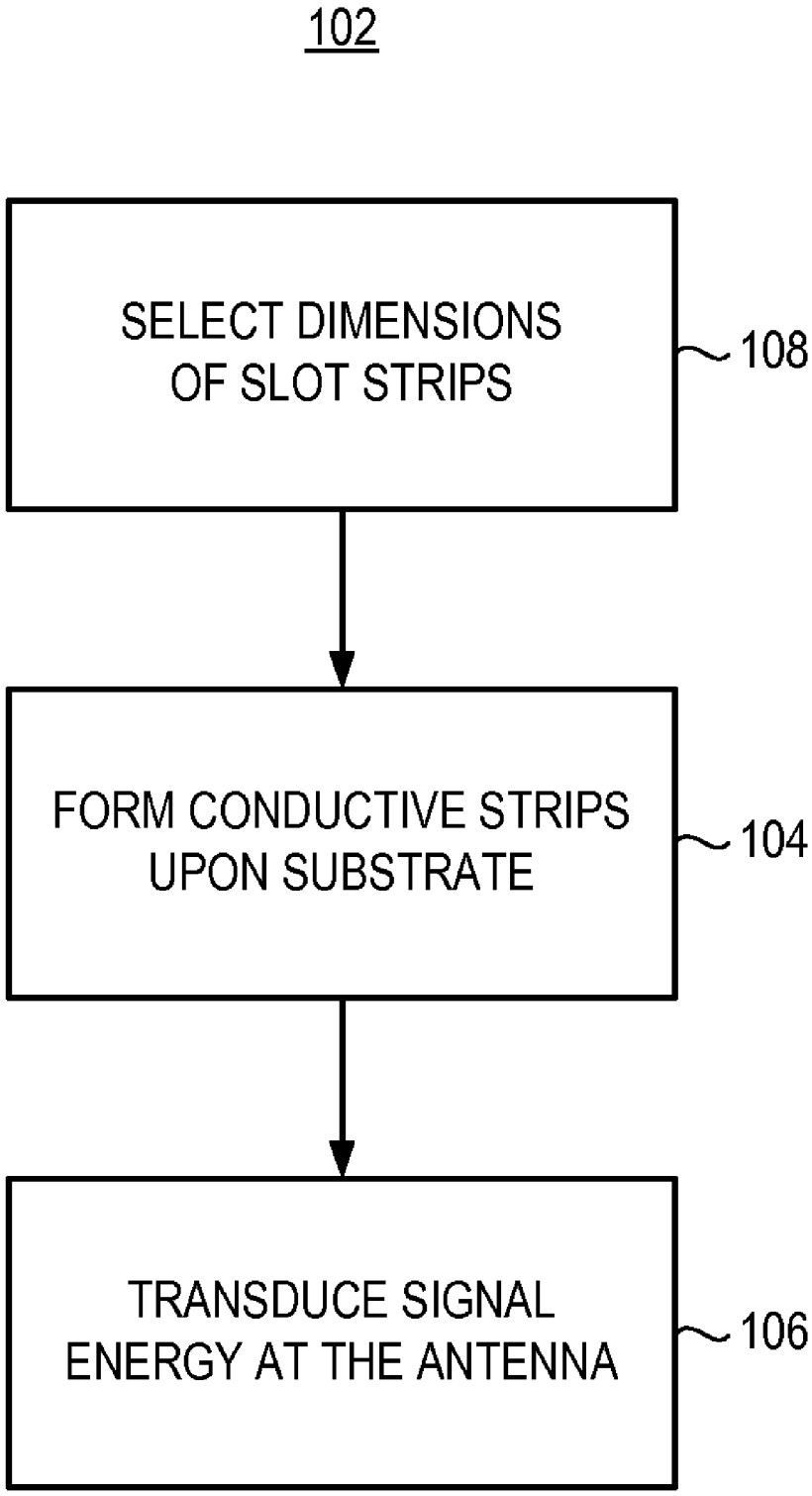
FIG. 10 illustrates a method flow diagram representative of the method of operation of an embodiment of the present invention.

FIG. 10 illustrates a method flow diagram, shown generally at 102, representative of the method of operation of an embodiment of the present invention. The method is for transducing signal energy at a radio device that is operable over multiple frequency bands. First, and as indicated by the block 104, a plurality of conductive slot-strips are formed upon a substrate. The slot-strips are formed such that an end edge of each of the slot-strips engage with an adjacent slot-strip of the plurality and extend at angles relative to one another. Each slot-strip is of a selected width and is of a selected length such that portions of the plurality exhibit resonance at levels responsive to frequency levels of signal energy therein and in which at least one portion of the plurality is resonant at each of the multiple frequency bands. Then, and as indicated by the block 104, the signal energy at the plurality of conductive slot-strips is transduced at any frequency within any of the multiple frequency bands over the radio device is operable.

In a further embodiment, and as indicated, the method further includes the introductory operation, shown at the block 108, of selecting the widths and lengths of each of the slot-strips.

Through appropriate selection of the configuration, and the lengths and widths of the design parameters, an antenna is formed that is resonant at any frequency band over a wide range of frequencies. The antenna is of small dimensions, permitting its positioning within the housing, or otherwise carried together with, a portable mobile station.

What is claimed is:

1. An antenna apparatus for a radio device operable over multiple frequency bands comprising a first frequency band, a second frequency band, and at least a third frequency band, said apparatus comprising:

a substrate; and a plurality of conductive slot strips disposed upon said substrate and electrically and physically connected together in a configuration of connected together slot-strips, an end edge of each of the slot strips of said plurality engaged with an adjacent slot strip of said plurality, extending at angles relative to one another, and each slot strip of a selected width and of a selected length, portions of said plurality of conductive slot strip exhibiting resonance at levels responsive to frequency levels of signal energy therein, at least one portion of said plurality of the connected-together slot strips resonant at each of the first, second, and at least third frequency bands, respectively, said plurality of slot strips configured to form a first lobed portion and a second lobed portion, a slot strip of said plurality of slot strips forming part of each of the first and second lobed portions and extending therebetween, said second lobed portion comprising a partial loop arrangement of concatenated slot strips; and a feed connection and a ground connection, said feed connection and said ground connection positioned at the second lobed portion.

2. The antenna apparatus of claim 1, wherein the first lobed portion comprises a serpentined arrangement of concatenated slot strips of said plurality.

3. The antenna apparatus of claim 2 wherein at least one of the slot strips of the first lobed portion configured in the serpentined arrangement is of a first width, at least one of the slot strips thereof is of a second width, and at least one of the slot strips thereof is of a third width.

4. The antenna apparatus of claim 1 wherein the slot strips of the second lobed portion configured in the partial loop arrangement are of substantially common widths.

5. The antenna apparatus of claim 1 wherein the selected width of any slot strip of said plurality is one of a first width, a second width, and a third width.

6. The antenna apparatus of claim 5 wherein at least one slot strip of said plurality is of the first width, at least one slot strip of said plurality is of the second width, and at least one slot strip of said plurality is of the third width.

7. The antenna apparatus of claim 1 wherein the angles at which the adjacent slot strips of said plurality extend comprise substantially perpendicular angles.

8. The antenna apparatus of claim 1 wherein the multiple frequency bands over which the radio device is operable comprise eleven frequency bands and wherein at least one portion of said plurality of slot strips is resonant at each of the eleven frequency bands.

9. The antenna apparatus of claim 1 wherein said substrate comprises a covering box that forms part of the radio device.

10. A method for transducing signal energy at a radio device that is operable over multiple frequency bands comprising a first frequency band, a second frequency band, and at least a third frequency band, said method comprising the operations of:

forming a plurality of conductive slot strips upon a substrate, the slot strips arranged to be electronically and physically connected together in a configuration of connected-together slot-strips such that an end edge of each of the slot strips engage with adjacent slot strips of the plurality and extend at angles relative to one another, each slot strip of a selected width and of a selected length such that portions of the plurality of the conductive strips exhibit resonance at levels responsive to frequency levels of signal energy therein and in which at least one portion of the plurality of the connected-together slot-strips is resonant at each of the first, second, and third frequency bands, respectively, the conductive slot strips formed during said operation of forming configured into a first lobed portion and a second lobed portion with a slot strip positioned to form part of both the first lobed portion and the second lobed portion, the second lobed portion disposed into a partial loop arrangement of the slot strips; and transducing the signal and energy at the plurality of the conductive slot strips at any frequency within any of the first, second, and at least third frequency bands over which the radio device is operable.

11. The method of claim 10 further comprising the operation of selecting the widths and lengths of each of the slot strips.

12. The method of claim 11 wherein the widths of the slot strips selected during said operation of selecting are selected to be of a first width, a second width, and a third width.

13. The method of claim 10 wherein the first lobed portion into which part of the conductive slot strips are configured comprises a serpentined arrangement of the conductive slot strips.

14. The method of claim 10 wherein said operation of selecting further comprises selecting lengths of the first and second lobed portions.

15. A method for forming an antenna for a radio device operable over a first frequency band, a second frequency band, and at least a third frequency band, said method comprising the operations of:

selecting dimensions of slot strips positionable into a bi-lobed configuration upon a substrate in a configuration of connected-together slot strips, with an end edge of each slot strip engaged with an adjacent slot strip, the dimensions selected to cause resonance of at least one part of the bi-lobed configuration at each of the frequency bands at which the radio device is operable; and disposing slot strips, of the dimensions selected during said operation of selecting, upon a substrate in the bi-lobed configuration.

* * * * *